US005833098A

United States Patent [19]

Gomi

[11] Patent Number: 5,833,098

[45] Date of Patent: Nov. 10, 1998

[54] SPEAR TUBE FOR BEER KEG

[75] Inventor: Tatsuya Gomi, Yokohama, Japan

[73] Assignee: Suntory Limited, Japan

[21] Appl. No.: 840,232

[22] Filed: Apr. 11, 1997

[30] Foreign Application Priority Data

Apr. 12, 1996 [JP] Japan ..... 8-090686

[51] Int. Cl.[6] ..... B65D 83/00

[52] U.S. Cl. ..... 222/400.7; 137/212

[58] Field of Search ..... 222/400.7; 137/212

[56] References Cited

U.S. PATENT DOCUMENTS

| | | | |
|---|---|---|---|
| 5,242,092 | 9/1993 | Riis et al. | 222/400.7 |
| 5,526,965 | 6/1996 | Degenkolbe et al. | 222/400.7 |
| 5,653,253 | 8/1997 | Larsen | 222/400.7 |

FOREIGN PATENT DOCUMENTS

| | | | |
|---|---|---|---|
| 0761555 | 12/1997 | European Pat. Off. . | |
| 07232799 | 5/1995 | Japan . | |
| 2188040 | 9/1987 | United Kingdom | 222/400.7 |
| WO 93/19003 | 9/1993 | WIPO | 222/400.7 |
| WO 94/16985 | 8/1994 | WIPO | 222/400.7 |

*Primary Examiner*—Philippe Derakshani
*Attorney, Agent, or Firm*—Bachman & LaPointe, P.C.

[57] ABSTRACT

A spear tube comprises a body connected with a keg neck interface of the beer keg. A gas valve, a down tube and a beer valve installed in the down tube are fittingly connected to the body. A stopper prevents the spear tube from popping out from the beer keg during detaching operation. A stopper portion of the stopper is formed protruding in the obliquely upward direction to penetrate a side hole of the body and has a cross-section a predetermined curvature shape. Therefore, the stopper functions to prevent the popping-out of the spear tube and is improved in its durability.

8 Claims, 5 Drawing Sheets

SPEAR TUBE FOR BEER KEG

BACKGROUND OF THE INVENTION

The present invention relates to improvements in a spear tube for a beer keg, and more particularly to a spear tube which is arranged to avoid popping-out thereof when detached from the beer keg.

In order to pour beer from a beer keg into a mug or jug through a dispenser having a dispense head attached to a keg neck interface of the beer keg, the internal pressure in the beer keg is increased by supplying carbon dioxide gas into the beer keg so as to push out the beer. A dispense head of the dispenser is connected to a spear tube screwed to the keg neck interface of the beer keg, so as to communicate the dispenser with the inside of the beer keg. In order to exchange a seal ring and/or a gas valve of recycled beer keg for maintenance in a factory, it is necessary to detach the spear tube from the keg neck interface of the beer keg. When the spear tube is detached, the spear tube pops out of the beer keg by the residual gas pressure in the beer keg and it is dangerous for an operator. It is necessary to sufficiently open the gas valve of a spear tube and to release the residual gas from the beer keg so as to avoid the popping out the spear tube. In this practical maintenance in a factory, it is not easy to check as to whether the gas in the beer keg is sufficient released. Therefore, it is necessary that the spear tube is provided with any safety device for preventing the popping out during the detaching thereof. Japanese Patent Provisional Publication No. 7-232799 discloses a spear tube having a stopper for preventing the popping out thereof. This stopper of the disclosed spear tube is arranged to have a stopper portion extending in the obliquely upward direction so as to penetrate a hole formed at a side wall of the body.

However, since this stopper portion is flat and straight plate and has not enough bending strength, it is not sufficient to restrain popping out of a spear tube in view of function and durability. Secondary this stopper portion is V-shaped and beer remains the upward part of this stopper portion. The remain beer is difficult to clean up and causes a decay of beer and a growth of fungus.

SUMMARY OF THE INVENTION

It is an object of the present invention to provide an improved spear tube which preferably performs the function as a stopper while ensuring the sufficient durability.

A spear tube according to the present invention is applied for a beer keg and comprises a body which is connected with a keg neck interface of the beer keg. The body has a side hole formed at a cylindrical wall thereof. A gas valve is fittingly connected with an inner portion of the body. An end of a down tube is in contact with the body through the gas valve. A beer valve is disposed in the down tube and in contact with the gas valve. A stopper connected to the down tube has a stopper portion which protrudes in the obliquely upward direction while penetrating the side hole of the body. A cross-section of the stopper portion is formed to have a predetermined curvature for reinforcement.

DETAILED DESCRIPTION OF THE INVENTION

Figure 1:
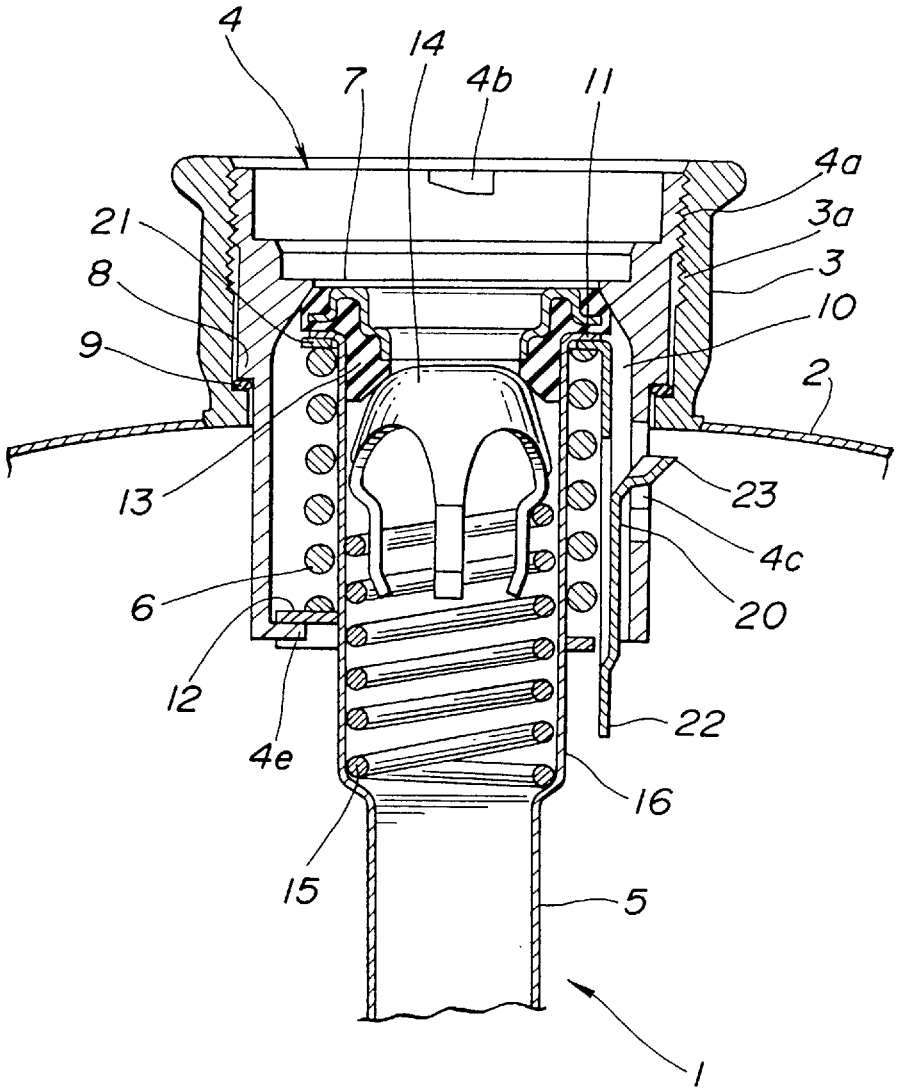
FIG. 1 is a cross sectional view of an essential part of a spear tube of an embodiment according to the present invention.

Referring to FIGS. 1 to 5D, there is shown an embodiment of a spear tube 1 for a beer keg 2 in accordance with the present invention.

The spear tube 1 comprises a body 4 whose external thread portion 4*a* is detachably screwed with an internal thread portion 3*a* of a keg neck interface 3 of a beer keg 2. A gas valve 13 for opening and closing a passage for carbon dioxide gas is disposed in the body 4. A down tube 5 is pushed upwardly by a coil spring 6 and its upper flange portion 11 is in contact with the gas valve 13. A beer valve 14 is disposed in the down tube 5 and is pushed by a coil spring 15 to be in contact with a lower and inner peripheral portion of the gas valve 13 functioning as a valve sheet. A stopper 20 made of an elastic member is engaged with the down tube 5 and extends blow between the coil spring 6 and the body 4. A stopper portion 23 of the stopper 20 protrudes in the obliquely upward direction so as to penetrate a hole 4*c* of the body 4. The stopper portion 23 is disposed such that a tip end thereof is generally in contact with a lower portion of the keg neck interface 3 in the beer keg 2.

Figure 2A:
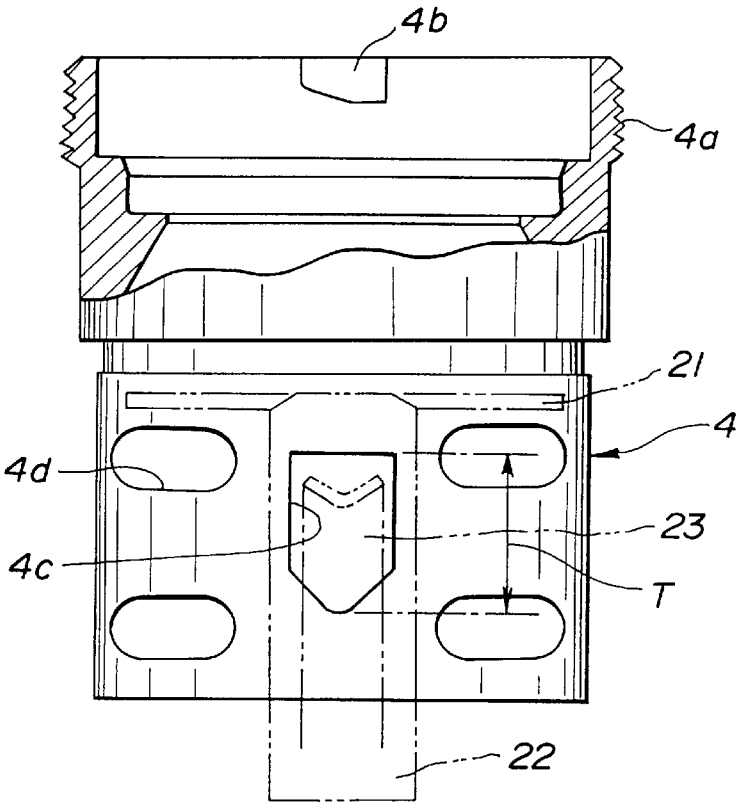
FIG. 2A is a side view, partially in cross section, of a body of the spear tube of FIG. 1.
Figure 2B:
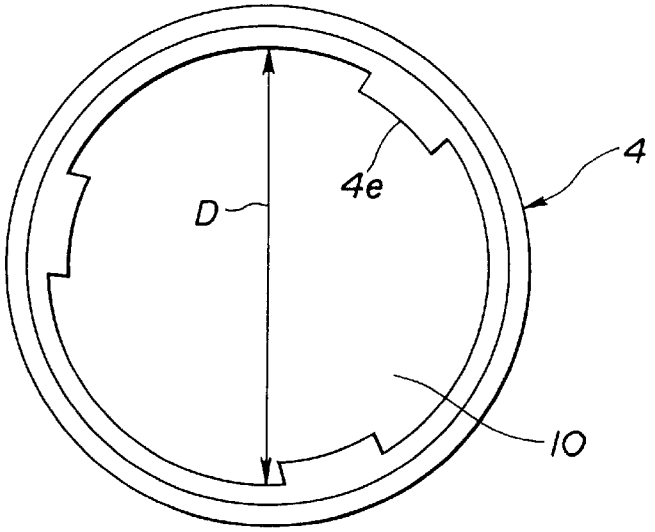
FIG. 2B is a bottom view of the body.

The hole 4*c* of the body 4, from which the stopper portion 23 protrudes, is formed such that the lower periphery of the hole 4*c* corresponds to the cross-sectional shape of the stopper portion 23, as shown in FIGS. 2A and 2B. That is, the hole 4*c* is formed into a pentagonal shape including a V-shaped lower periphery and has a vertical dimension T which is equal to or greater than a stroke of the down tube 5 during the beer pouring. By this correspondence of the lower periphery of the hole 4*c* of the stopper portion 23, it becomes possible to prevent the deformation of the stopper portion 23 caused by the impact of colliding the stopper portion 23 to the lower periphery of the hole 4*c* when the spear tube 1 is detached from the beer keg 2 due to the residual gas pressure. Further, the size of the hole 4*c* is suppressed small. Therefore, when the stopper 20 is moved up and down in company with the gas valve 13 and the down tube 5 during the beer pouring, the stopper portion 23 is moved up and down without being drawn inside of the body 4.

As shown in FIGS. 4A to 5D, the stopper 20 is constituted by a ring portion 21 which is engaged with the downward surface of the flange portion 11 of the down tube 5, and an arm portion 22 which is bent perpendicularly from the ring portion 21 and extends downward between the coil spring 6 and the body 4. The stopper portion 23 is integrally connected with the arm portion 22 so as to obliquely project from the hole 4*c* to the outer side of the body 4. The arm portion 22 has a generally inverse U-shaped slit 24 which defines the stopper portion 23 on the arm portion 22. The stopper portion 23 is formed by bending a portion surrounded by the slit 24. More particularly, the base of the stopper portion 23 which is connected with the arm portion 22 is bent twice and there is minor difference in lever to be parallel with the arm portion 22. The tip of the stopper portion 23 continuous to the parallel portion is bent obliquely and upward so as to obliquely and upwardly project from the hole 4*c* when the spear tube 1 is installed in the beer keg 2. In order to improve the strength of the stopper portion 23, the cross section of the tip of the stopper portion 23 is formed to have a predetermined curvature for reinforcement. That is, as shown in FIGS. 4A to 4D, the cross-section of the tip of the stopper portion 23 is formed into V-shape. Further, it will be understood that the cross-section of the tip of the stopper portion 23 may be formed into arc-shape as shown in FIGS. 5A to 5D.

The body 4 is formed into a cylindrical shape which has a plurality of ratchets 4*b* formed at predetermined intervals on the circumferential direction. Through the ratchets 4*b*, a dispense head or a tool for installation is engaged to an upper opening portion periphery of the body 4. An inner step portion 7 is formed in the vicinity of the upper opening portion of the body 4. An outer step portion 8 is formed at a generally intermediate portion of the body 4 so that a seal ring 9 is disposed between the outer step portion 8 of the body 4 and an inner base of the keg neck interface 3 of the beer keg 2. The body 4 has the hole 4*c* through which the stopper portion 23 of the stopper 20 is outwardly projected, a plurality of holes 4*d* functioning as a passage for beer and carbon dioxide gas, and a hollow 10 for the down tube 5. The hole 4*c* and the holes 4*d* are formed at the circumferential wall of the body 4, and the hollow 10 is formed at a bottom portion of the body 4. Three bayonet pieces 4*e* are formed at the bottom portion periphery of the body 4 at equal intervals toward the center axis of the body 4. A retaining disc 12 for supporting the coil spring 6 is hooked on the bayonet pieces 4*e*.

Figure 3A:
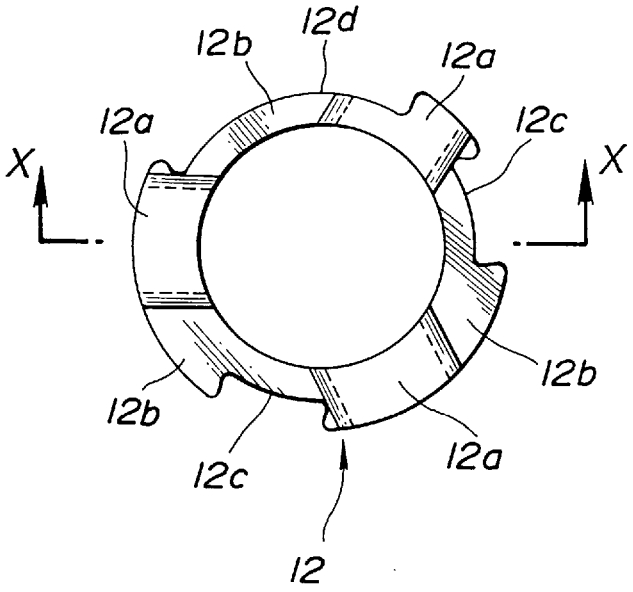
FIG. 3A is a plane view of a retaining disc of the spear tube of FIG. 1.
Figure 3B:
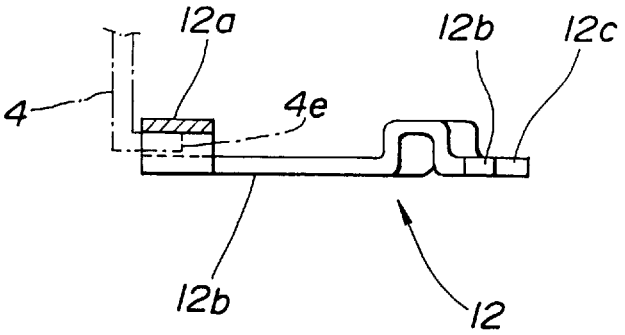
FIG. 3B is a cross sectional view taken on line X—X of FIG. 3A.
Figure 4A:
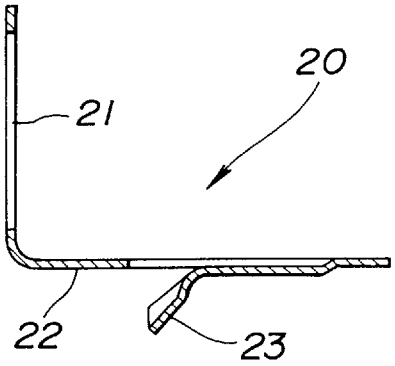
FIGS. 4A, 4B, 4C and 4D are a cross-sectional side view, a plane view, an expansion plane view and a partially enlarged view of a stopper of the spear tube of FIG. 1, respectively.
Figure 4B:
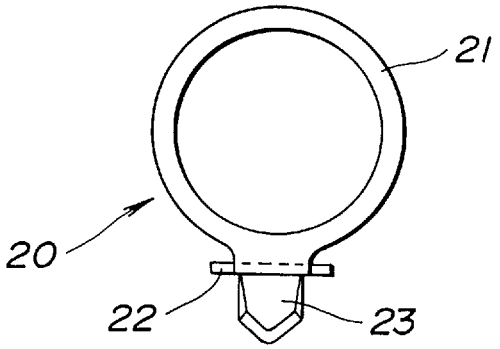
Figure 4C:
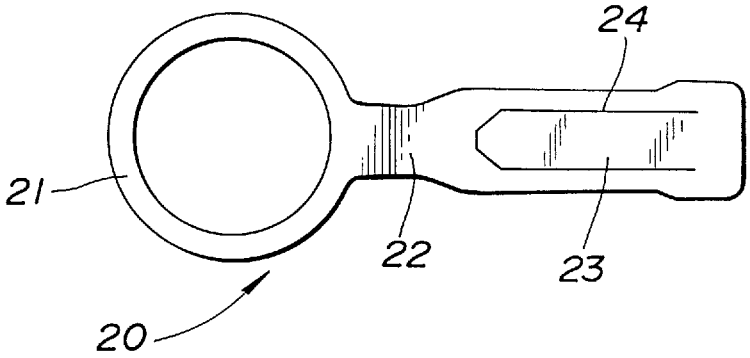
Figure 4D:
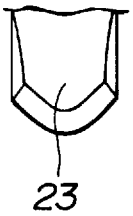
Figure 5A:
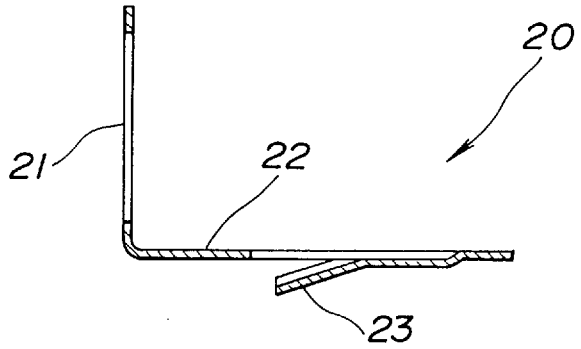
FIGS. 5A, 5B, 5C and 5D are a cross-sectional side view, a plane view, an expansion plane view and a partially enlarged view of another example of the stopper of the spear tube, respectively.
Figure 5B:
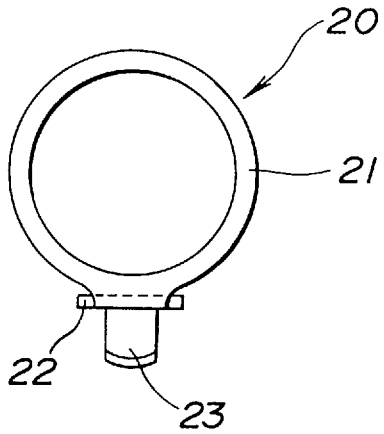
Figure 5C:
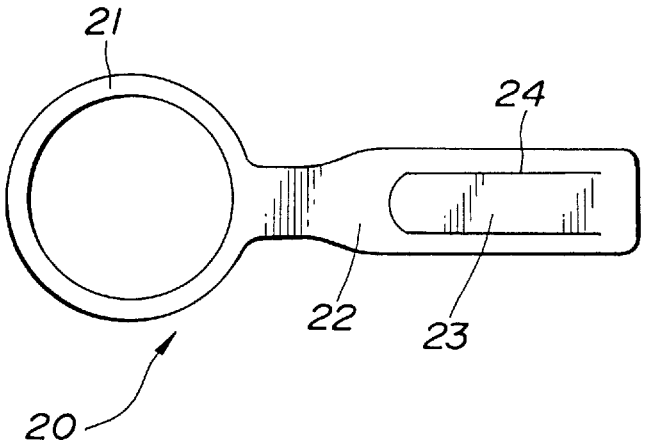
Figure 5D:
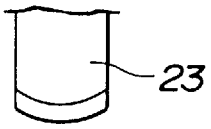

As shown in FIGS. 3A and 3B, the retaining disc 12 formed into a ring shape has three grooves 12*a* formed at equal intervals and depressions 12*c* and 12*d* formed at a flange portion 12*b*. The depression 12*d* is formed at a portion from the flange portion 12*b* to the groove portion 12*a*. The diameter of the flange portion 12*b* is generally the same as the inner diameter D of the body 4 shown in FIG. 2B. Therefore, by press-fitting the retaining disc 12 to the hollow 10 formed at the bottom portion of the body 4 so as not to overlap the bayonet pieces 4*e* and the flange portions 12*b* and by rotating it by 120 degree angle as shown in FIG. 2B, the groove portions 12*a* are respectively connected to the bayonet pieces 4*e* so as to be fixed with each other as shown in FIG. 3B. The lower end portion of the coil spring 6 is in contact with the downward surface (upper side) of the groove portions 12*a* of the retaining disc 12.

The inner step portion 7 of the body 4 functions as a valve sheet with which the circular gas valve 13 is fittingly in contact. The lower portion of the gas valve 13 has an outer peripheral portion in contact with the upper surface of the flange portion 11 of the down tube 5 and a lower inner periphery functioning as a valve sheet for the beer valve 14. The outer peripheral portion and the lower inner periphery of the gas valve 13 are in contact with the beer valve 14 pushed (biased) by the coil spring 15 in the down-tube 5. The coil spring 15 is disposed in an enlarged portion 16 of the down tube 5. The flange portion 11 is formed at the upper end portion of the down tube 5. The ring portion 21 of the stopper 20 is in contact with the flange portion 11, and the upper end portion of the coil spring 6 is in contact with the ring portion 21. The lower end portion of the coil spring 6 is in contact with the retaining disc 12 installed in the inner bottom portion of the hollow 10 of the body 4.

When the spear tube 1 according to the present invention is installed to the keg neck interface 3 of the beer keg 2 by inserting and screwing, the stopper portion 23 is momentarily bent inward of the inner wall of the body 4 owing to the elastic characteristic thereof. Then, when the stopper portion 23 reaches the hole 4*c*, the stopper portion 23 protrudes into the hole 4*c* and out of the body 4.

By the installation of the spear tube 1 to the keg neck interface 3, the beer valve 14 is always in contact with the gas valve 13. Therefore, when a not-shown dispense head is installed to the body 4 and when a handle of the dispense head is pushed down, the gas valve 13 and the beer valve 14 are pushed down and opened by a pressuring portion of the dispense head. This opening enables the carbon dioxide gas supplied from a carbon dioxide gas cylinder connected to the dispense head to be flowed into the beer keg 2 through a passage between the gas valve 13 and the body 4. The inner pressure in the beer keg 2 is raised up, and it becomes possible that beer in the beer keg 2 is flowed into the dispense head through the down tube 5, so that the beer is poured from the dispenser into beer mug or jug. At this time, the stopper 20 is moved up and down upon accompanied with the operation of a handle of the dispense head, and the stopper portion 23 is moved up and down while projecting from the hole 4*c* without being drawn inside of the wall of the body 4.

When the spear tube 2 is to be detached from the keg neck interface 3 for maintenance thereof, the dispense head is detached and a tool (not shown) is inserted into the body 4. By the insertion of the tool into the body 4, the down tube 5 is moved down and the residual gas in the beer keg 2 is discharged through a clearance formed between the down tube 5 and the gas valve 13 to the outside of the beer keg 2. Further, when the residual gas is entirely released, the tool is rotated on the axial center of the spear tube 1 so that the external thread portion 4*a* of the body 4 is detached from the internal thread portion 3*a* of the keg neck interface 3.

If it is not complete to release the gas in the beer keg 2, the spear tube 1 acts to pop out form the keg neck interface 3. However, the stopper portion 23 of the stopper 20 prevents the popping-out of the spear tube 1 by the hooking of the stopper portion 23 to the lower periphery of the keg neck interface 3. Even if the impact of collision is additionally applied to the popping out of the spear tube 1, the stopper portion 23 keeps its shape to perform its functions as a stopper because of the reinforcement by forming its cross-section into curved shape such as a V-shape or arc-shape.

In order to completely detach the spear tube 1 from the beer keg 2, it is necessary to pull the stopper portion 23 into an inner side of the body 4 by using a jig. Keeping the stopper portion 23 at a position between the coil spring 6 and the inner wall of the body 4, the spear tube 1 is pulled out from the keg neck interface 3.

With this embodiment, the hole 4*c* of the body 4 has a vertical length which is equal to or greater than a stroke of the down tube 5 moved by a beer pouring operation, and the stopper portion 23 which prevents the spear tube 1 from popping out from the keg neck interface 3 during a detaching operation is projected from the hole 4*c*. Therefore, it becomes possible to avoid a deforming movement that the stopper portion 23 is drawn inside of the inner wall of the body 4 during the beer pouring. This improves the durability of the stopper portion 23 and suppresses the breakage of the stopper portion 23. Furthermore, the stopper portion 23 is reinforced by being the cross section thereof into a V-shape or arc-shape. Therefore, even if the stopper portion 23 is collided with the lower portion of the body 4, the stopper portion 23 keeps its shape and its function as a stopper. In addition, since the stopper portion 23 is arranged so as not to have a portion at which beer remains, the spear tube 1 is easily cleaned and avoids the decay of beer and a growth of fungus.

While the invention has been shown and described with reference to a preferred embodiment thereof, it will be understood by those skilled in the art that the foregoing and other changes in form and details can be made therein without departing from the spirit and scope of the invention.

The entire disclosure of Japanese Patent Application No. 8-90686 filed on Apr. 12, 1996 including specification, claims, drawings and summary are incorporated herein by reference in its entirety.

What is claimed is:

1. A spear tube for a beer keg comprising:

a body connected with a keg neck interface of the beer keg, said body having a side hole formed at a cylindrical wall thereof;

a gas valve fittingly connected with an inner portion of said body;

a down tube whose one end is in contact with said body through said gas valve;

a beer valve disposed in said down tube and in contact with said gas valve; and a stopper including a ring portion which is connected to said down tube and an arm portion which is bent from the ring portion and extends perpendicularly from the ring portion, the arm portion having generally U-shaped slit which defines a stopper portion on the arm portion, the stopper portion being formed bent in cross section to have a predetermined curvature and Protruding in the obliquely upward direction from the arm portion while penetrating the side hole of said body, a cross-section of the stopper portion being formed to have a predetermined curvature.

2. A spear tube as claimed in claim 1, wherein the stopper portion has a cross-section of a V-shape.

3. A spear tube as claimed in claim 1, wherein the stopper portion has a cross-section of an arc-shape.

4. A spear tube as claimed in claim 1, wherein the side hole of said body is formed such that a lower periphery of the side hole has a shape corresponding to the cross-sectional of the stopper portion.

5. A spear tube as claimed in claim 1, wherein a part of the portion surrounded the U-shaped slit is bent so as to protrude in the obliquely upward direction while penetrating the side hole of said body.

6. A spear tube as claimed in claim 1, wherein the side hole of said body has a vertical dimension which is equal to or greater than a stroke of said down tube moved by a beer pouring operation.

7. A spear tube as claimed in claim 5, wherein a base of the stopper portion is bent twice and this is minor difference in level to be parallel with the arm portion, the tip of the stopper portion continuous to the parallel portion being bent obliquely and upward so as to obliquely and upwardly project from the side hole when the spear tube is installed in the beer keg.

8. A spear tube for a beer keg, said spear tube comprising:

a cylindrical body connected with a keg neck interface of the beer keg, said body having a side hole formed at a cylindrical wall thereof and an inner step formed at an inside thereof;

a gas valve fittingly connected with an inside wall of said body;

a first coil spring disposed in said body;

a down tube including a flange portion and an enlarged portion continuous to the flange portion, the flange portion being pushed by said first coil spring so that the flange portion is in contact with said gas valve, said down tube;

a beer valve disposed in said down tube and in contact with said gas valve;

a second coil spring disposed in the enlarged portion of said down tube and pushing said beer valve toward said gas valve;

a stopper including a ring portion which is connected to said down tube and an arm portion which is bent from the ring portion and extends downward from the ring portion, the arm portion having generally U-shaped slit which defines a stopper portion on the arm portion, the stopper portion being formed bent in cross section to have a predetermined curvature for reinforcing and protruding in the obliquely upward direction while penetrating the side hole of said body, a cross-section of the stopper portion being formed to have a predetermined curvature for reinforcing.

* * * * *